United States Patent [19]

Smejda

[11] Patent Number: 4,494,389

[45] Date of Patent: Jan. 22, 1985

[54] CONTINUOUS SYSTEM FOR TREATING FABRICS

[76] Inventor: Richard K. Smejda, P.O. Box 344, Riverside, Paterson, N.J. 07544

[21] Appl. No.: 568,436

[22] Filed: Jan. 5, 1984

Related U.S. Application Data

[63] Continuation-in-part of Ser. No. 306,081, Sep. 28, 1981, abandoned.

[51] Int. Cl.[3] ..... D06B 17/04

[52] U.S. Cl. ..... 68/5 C; 68/8

[58] Field of Search ..... 68/3 R, 5 C, 8, 9, 10, 68/11, 210; 242/79; 414/911

[56] References Cited

U.S. PATENT DOCUMENTS

| | | | |
|---|---|---|---|
| 946,916 | 1/1910 | Gessner | 68/8 |
| 1,259,526 | 3/1918 | Knibiehler et al. | 68/9 X |
| 2,951,356 | 9/1960 | Mellbin | 68/8 |
| 3,331,224 | 7/1967 | Alberto et al. | 68/8 |
| 3,357,212 | 12/1967 | Schiffer | 68/8 |
| 3,509,745 | 5/1970 | Johnston | 68/9 X |
| 4,195,498 | 4/1980 | Pellerin | 68/3 R |

FOREIGN PATENT DOCUMENTS

| | | | |
|---|---|---|---|
| 396030 | 10/1924 | Fed. Rep. of Germany | 68/10 |

*Primary Examiner*—Philip R. Coe

*Attorney, Agent, or Firm*—Edward R. Weingram

[57] ABSTRACT

A continuous system applies chemical solutions to successive rolls of fabric from alternate applicators. The treated rolls pass through a plurality of stations within a common development chamber, emerging fully processed in one continuous movement. Radiant heat and steam are applied throughout the chamber and a winding and rewinding operation provides uniform treatment. An inclined chamber section permits gravity feed of the rolls.

14 Claims, 9 Drawing Figures

FIG. 3
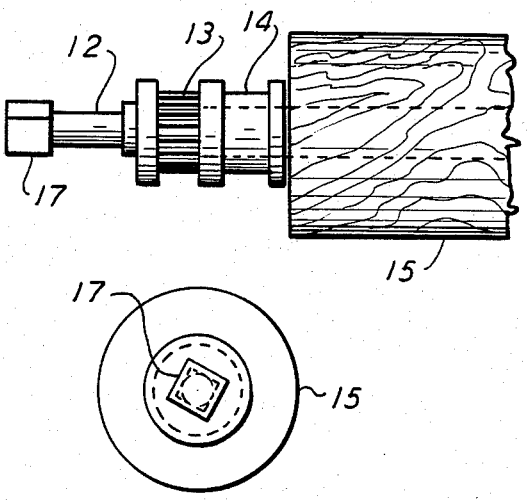
FIG. 4
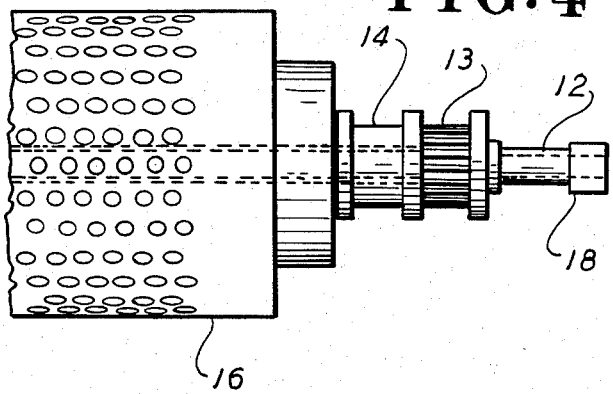
FIG. 3a
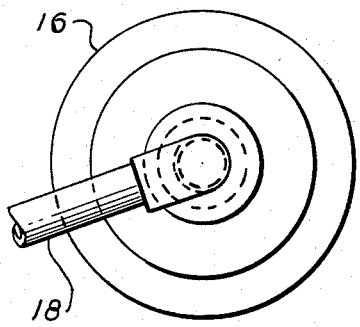
FIG. 4a
FIG. 5
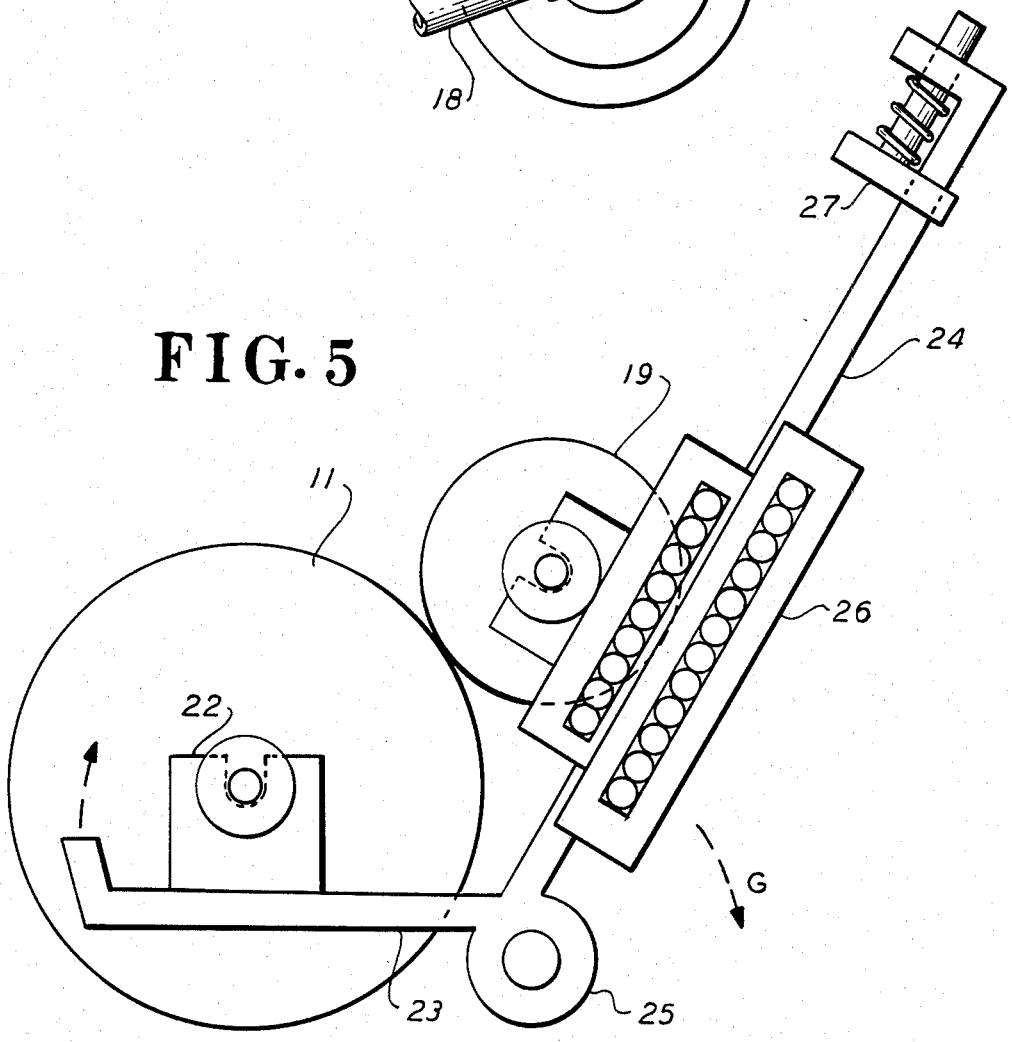

CONTINUOUS SYSTEM FOR TREATING FABRICS

This application is a continuation-in-part application of Ser. No. 306,081, filed Sept. 28, 1981 and now abandoned.

BACKGROUND OF THE INVENTION

1. Field of the Invention

This invention relates to systems and processes for applying chemical solutions, colors and patterns to fabrics and for developing and fixing the chemicals in a continuous operation within a common chamber to provide a dyed, or printed and fully processed material.

2. Description of the Prior Art

In the past, it has been known to use batch-heat development of single large rolls of fabric sealed in separate steam chambers each containing one roll. This individual arrangement is very cumbersome and inefficient with respect to energy usage, requires excessive time, space and handling, and is also quite costly. In addition, the process results in the occurrence of undesired swelling and uneven exposure.

Wet fibers being treated and developed normally swell when subjected to heat and steam in order to open intermolecular spaces to permit entry of dyes and other chemicals. Steam chambers containing single rolls hold the rolls for several hours and may require one hour or more just to feed the fabric in. As the roll is heated to the desired temperature, the inside of the roll tends to swell, while the outside does not expand and acts as a tight wrapping. This can cause undesired squeezing of inner layers and migration of chemicals to areas of lower pressure. The result is uneven treatment and unacceptable fabrics. Uneven exposure results from the fabrics being heated in one operation while simultaneously being wound in a roll during the period of treatment. The inside of the roll is then exposed to the chemicals and heat for the full period, while the outside layers have just been impregnated. In a typical operation, the difference in time of exposure to heat and chemicals of the inside to the outside is two or more hours, or a ratio of 1:2. This differential in treatment may result in fabric which is unacceptable.

SUMMARY OF THE INVENTION

It is therefore an object of the present invention to provide a fabric treatment system which can process a highly diversified selection of fabrics on a continuous basis.

It is another object of the invention to provide a fabric treatment system which will save time, energy, space and equipment.

A further object of the invention is to employ a plurality of applicators in sequence which can handle various fabric treatments and operations.

A still further object of the invention is to utilize alternate feeding of fabric to be wound on rolls through at least two applicators to limit the downtime between successive rolls entering the processing chamber.

Yet another object is to assure exact repetitive treatment of fabrics through accurate monitoring of time, temperature, moisture content and humidity, exposure and movement through a common chamber.

An additional object is to provide uniform treatment for applying various dyes, colors and printed patterns permitting identical matches for identical formulations.

These objects are achieved in a novel fabric treatment system wherein fabric is fed into a first roll-winding station of a processing chamber through one of at least two alternate applicators which apply a desired dye, color or pattern to the material. While one applicator feeds impregnated goods to the wind-up station, the other applicator is ready to follow with another roll to provide fabric continuously into and along the chamber. The chamber includes a plurality of successive work stations at which the rolls are subjected to regulated radiant heat and steam for predetermined intervals within a common enclosure. Following the wind-up station is a rest station which holds the roll for a limited time under exact moisture and temperature conditions to permit swelling of the fabric to occur without undesired migration of the impregnating materials. The roll is then fed to a rewind station which winds the roll onto a second core, preferably of a perforated type, to permit steam to penetrate into the inner layers of the fabric. The rewinding operation provides uniform exposure to heat and moisture while relieving the pressure caused by the swelling of the fibers. A preferred temperature of at least 100° C. is maintained to achieve the desired steam conditions. The roll is then transferred to a conveyor belt or chain within an inclined section of the chamber to move the rolls downward by gravity while applying further heat and steam treatment to complete the fixing of the dye or pattern. Several rolls are processed and developed simultaneously as they move along the chamber. The finished rolls then exit the chamber to permit hot or cold storage or further treatment. Other objects and advantages will become apparent from the following description in conjunction with the accompanying drawings.

BRIEF DESCRIPTION OF THE DRAWINGS

FIG. 3 is a top partial view of a core for a roll of fabric;

FIG. 3*a* is a side view of the core of FIG. 3;

FIG. 4 is a top partial view of a perforated core and hollow shaft for injection of steam or chemical solutions into the center of a fabric roll;

FIG. 4*a* is a side view of the core of FIG. 4;

FIG. 5 is a side view showing the rolls at the beginning of the rewind operation;

DESCRIPTION OF THE PREFERRED EMBODIMENTS

Figure 1:
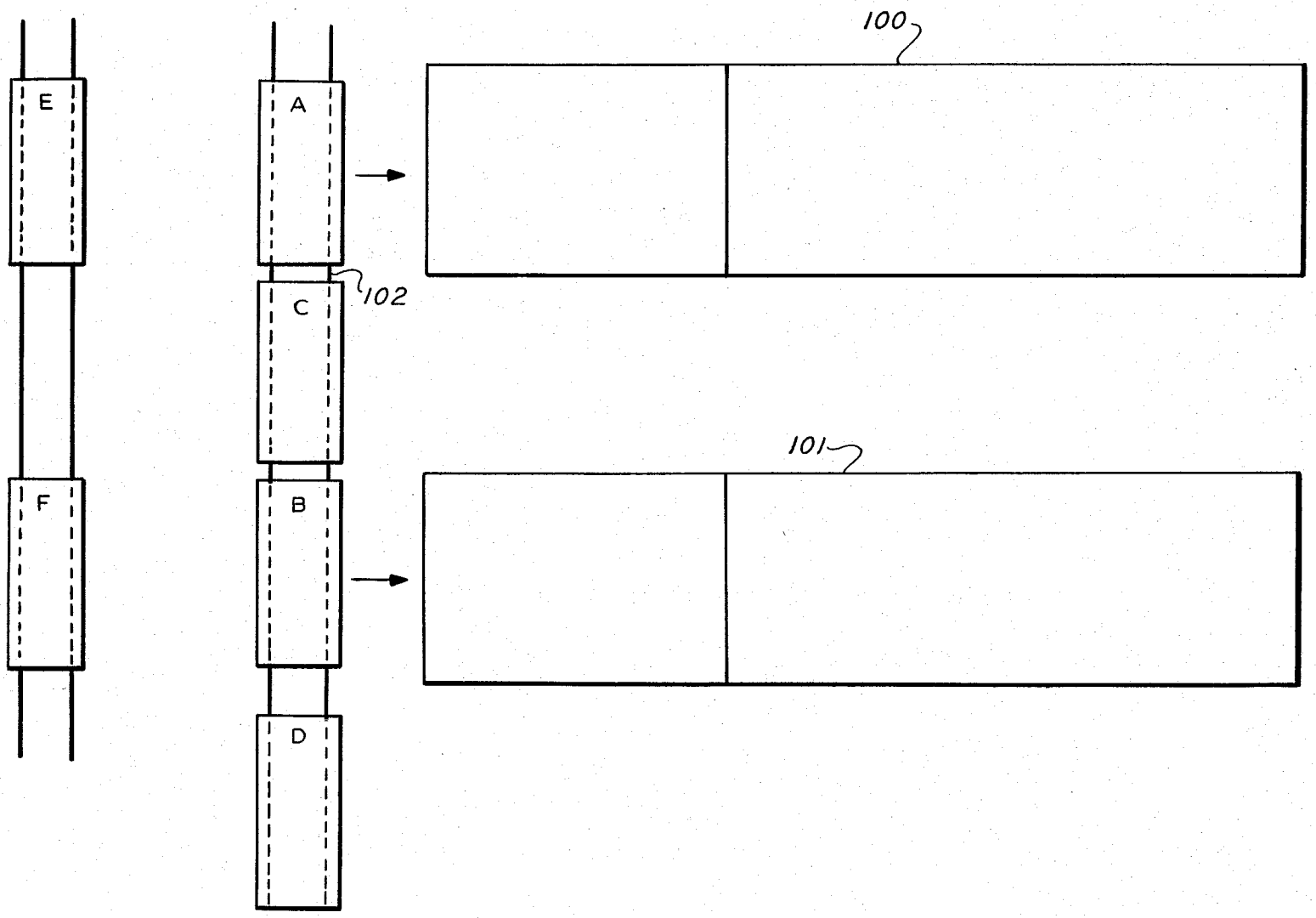
FIG. 1 is a schematic plan view of a plurality of applicators positioned adjacent two development chambers.

As shown in FIG. 1, two enclosed parallel chambers 100, 101 each provide a plurality of successive stations for processing rolls of fabric which are subjected to various treatments including heat and moisture for developing or fixing dyes, colors and patterns which are applied to the fabric. A plurality of applicators A–F, which may be positioned on rails 102, are disposed adjacent the entrance to chambers 100, 101 for applying the various chemical solutions, patterns and dyes, to the rolls of fabric which are fed through the applicators before passing through the chambers. Two applicators are positioned so that when the desired pattern or color applied to a roll of fabric is completed by one, another roll is moved into place to permit the alternate applicator to continuously feed the new roll into the chamber without interruption.

Figure 2:
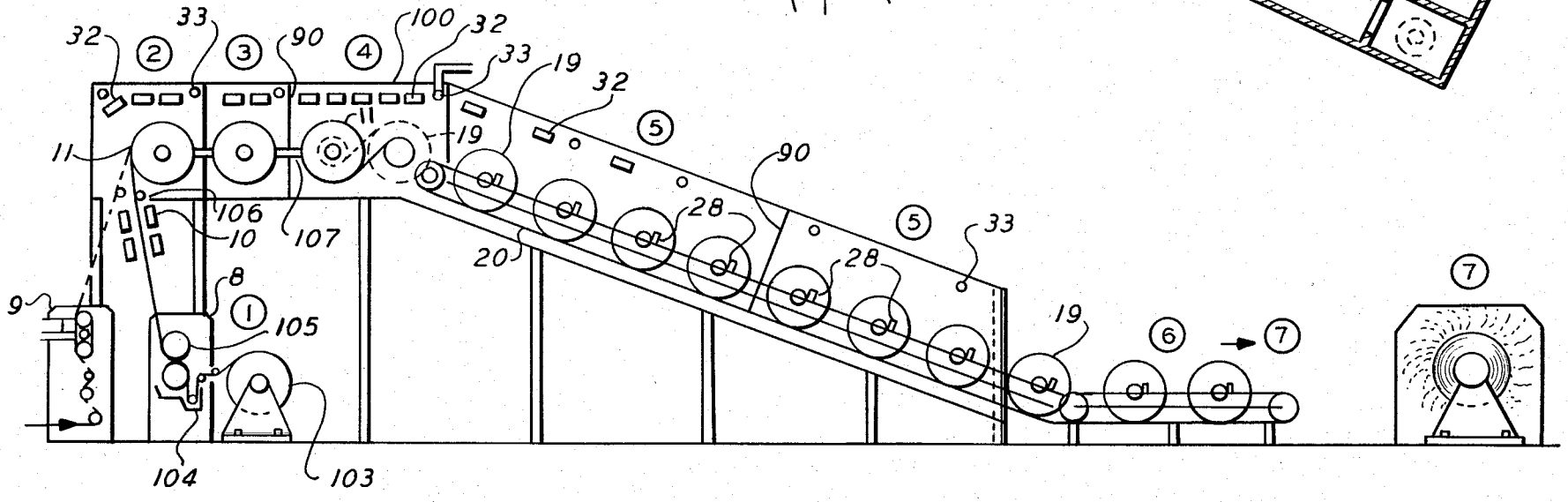
FIG. 2 is a schematic side view of a development chamber containing a plurality of fabric rolls at various work stations and a pair of applicators feeding fabric into the chamber.

As shown in FIG. 2, a first applicator 8 at station 1 applies a desired dye and/or chemical composition to a roll of fabric 103 which is unwound from the supply roll as it is fed through the applicator. The web of fabric passes through the solution in a tank 104 and between a pair of pads 105 which extract excess liquid. The fabric is then drawn upward through a series of radiant heaters 10 and through an opening 106 and wound onto a take-up roll 11 within chamber 100 at station 2 for preheating. Chamber 100 contains additional radiant heater devices 32 and a plurality of inlets 33 for directing steam into the space around each roll. The steam and radiant heaters maintain a temperature of, for example, about 50° C. at this stage. The roll is then moved into rest station 3 for continued application of heat and to permit normal swelling. When station 2 is emptied of the first roll, another roll is moved into position for winding onto another core of the next take-up roll 11. Suitable means are provided for moving empty take-up cores into station 2 for winding up succeeding rolls of material. The second applicator 9 may apply different striped patterns and colors to the fabric with successive alternate applicators and rolls being provided to perform continuous feeding.

After a predetermined period of rest and swelling of fabric at station 3, the roll is moved into rewind station 4. At this location, the material on the roll is subjected to further heat and steam while being rewound from roll 11 to roll 19. At this stage the temperature of the steam is increased to at least 212° F., or preferably from 220°-240° F., which is over 100° C., with radiant heaters maintaining this temperature to provide a state of phase transition in a controlled atmosphere. The rewinding permits the application of heat and moisture to each individual section and layer of the web of material and provides a second heating step wherein the outer layers on roll 11 are rewound onto the inner layers of roll 19 and vice versa. The reversal of material provides uniform exposure to heat and steam and alleviates the pressure of the swollen material to avoid damage. The core of roll 19 may be a perforated type 16, shown in FIG. 4, which permits the heated steam under pressure to penetrate and exit through the roll or through the core. After rewinding, the empty core may be positioned to receive the next roll to be rewound. The application of heat in two steps by the rewinding operation permits higher operating speeds and greater penetration of heat and steam. The steam is maintained at a level within chamber 100 which is above and encompasses all rolls except the last one at the lower end exiting the inclined portion of the chamber. The continued application of steam maintains moisture on the rolls to prevent drying out.

FIGS. 3 and 3*a* show a typical core 15, which may be of wood, on which a fabric roll 11 is wound. A square center bar 17 permits engagement of a clutch drive mechanism. The bar is connected to a shaft 12 carrying a pinion 13 and bushing 14 which are secured by set screws and hold the core in position. A drive gear may also be coupled to pinion 13 for connection to a drive motor.

FIGS. 4 and 4*a* show the perforated core, preferably of steel, used for the wind-up of roll 19. A center pipe 18 having a swivel joint connects to a hollow shaft 12 to supply steam which passes through the perforations of core 16 into the fabric roll. A separate drive chain or belt 107 may be used to move the rolls through stations 2, 3 and 4.

Figure 6:
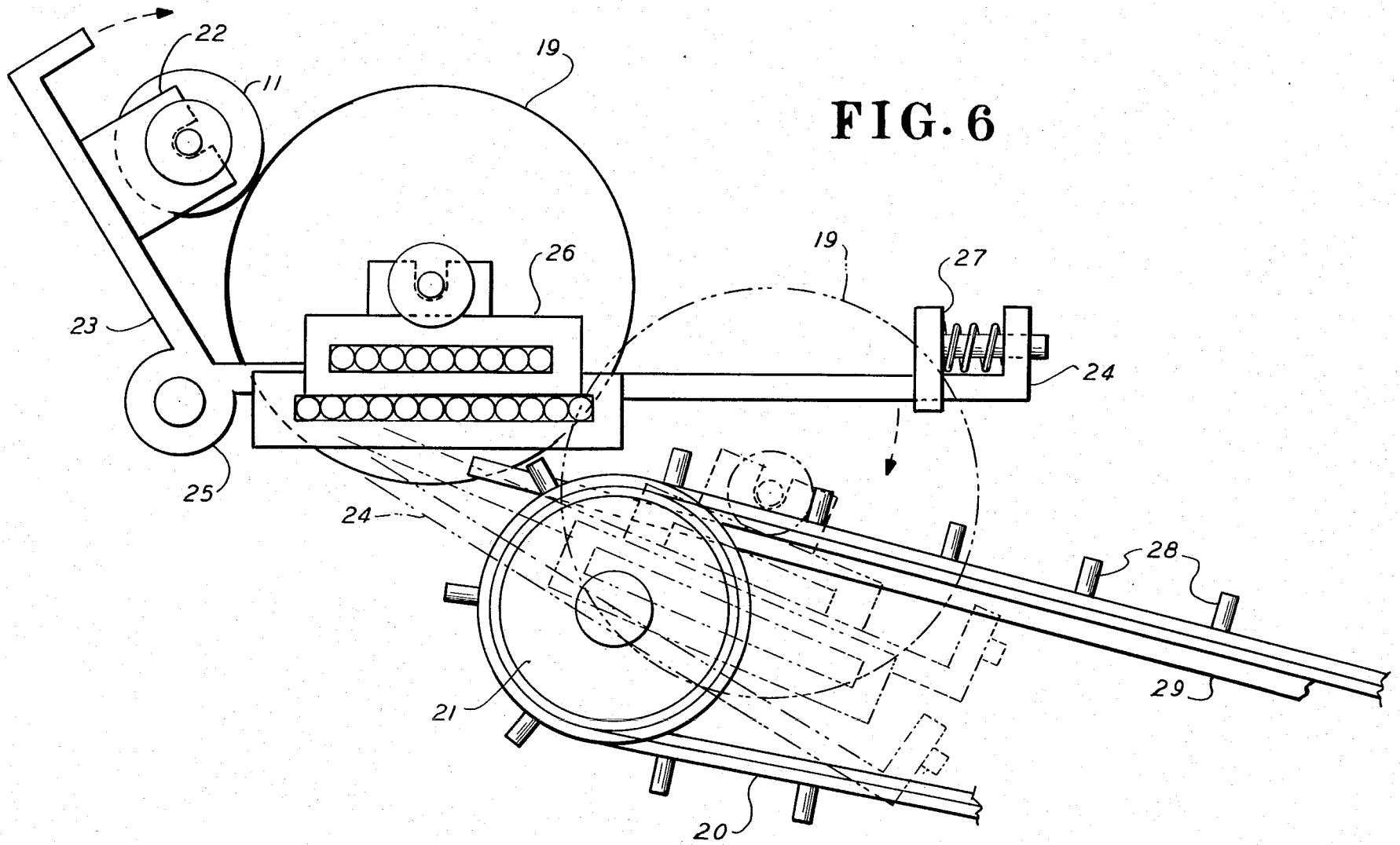
FIG. 6 is a side view showing the rolls near the end of the rewinding and the transfer of a roll onto a conveyor chain of an inclined chamber section.

As shown in FIG. 5, at rewind station 4, roller 11 is held in a support 22, positioned on a lever arm 23 which is rotatable about a center 25. The core of the rewind roll 19 rests in another support carried on a rollerslide 26 on a second lever arm 24 also connected to rotate about center 25. Rollerslide 26 keeps roll 19 in engagement with roll 11 to avoid creases and shifting of layers during the rewind operation. As the rewind operation proceeds, roll 11 becomes smaller and lighter and roll 19 larger and heavier, causing lever 24 to rotate downwardly in the direction of arrow G. When the rewinding is completed, as shown in FIG. 6, roll 19 causes lever 24 to move down toward the top end of chain drive 20. The rollerslide 26 then slides down lever 24 carrying roll 19 against a spring dampened bumper 27 and lever 24 moves down further to deposit roll 19 on the top of chain 20 between vertical pegs 28. Lever arm 23 may also be separated from lever 24 and the center to be held stationary if so desired. Bushings 14 on each side of the roll rest against pegs on each side of the chain and the pinions 13 engage the rack 29 of the chain. The chain within chamber 100 is positioned at an angle of from 5 to 30 degrees with respect to the horizontal so that the weight of the roll causes the chain to be driven clockwise around drive wheel 21. The roll and top of the chain thus move downwardly within the angled station 5 of chamber 100 at a predetermined speed.

A plurality of rolls are likewise wound and rewound and successively placed on chain 20 which moves continuously within the common chamber 100. The rolls are subjected to further radiant heat by heaters 32 and steam from inlets 33 until the dye color or pattern is completely developed or set. The rolls then emerge at the other end of chamber 100. The spacing of pegs 28 can be varied to permit anywhere from four to twenty rolls to be carried at the same time within the chamber depending upon the size of the rolls. Vertical partitions 90 between stations or within the angled chamber section may be used to permit different temperature and humidity levels to be employed at different locations. This can be done by placement of radiant heaters which can be turned on and off as desired. The speed and time of the operation can also be varied depending upon the type of fiber and dyes utilized. The movement of the chain is driven by the weight of the rolls and may be controlled by suitable brakes and clutches. Only two drive motors are required, one for the wind-up of roll 11 at station 2 and another for the rewind of roll 19 at station 4. These maintain the rotation and movement of the rolls at a predetermined speed.

After emergence of the rolls from chamber 5 a horizontal section at station 6 is used to permit cooling and for temporary storage. From this point, rolls with solid cores are removed for further operations, while rolls with perforated cores can be inserted into a rotary washer shown at station 7, FIG. 2. This step provides a washing and cleaning operation. Other finishing solutions can also be applied at this stage. Further operations following removal from the main processing chamber may include use of an autoclave providing further steam treatment or additional heating and drying, or application of ultrasonic waves, for special requirements.

Figure 7:
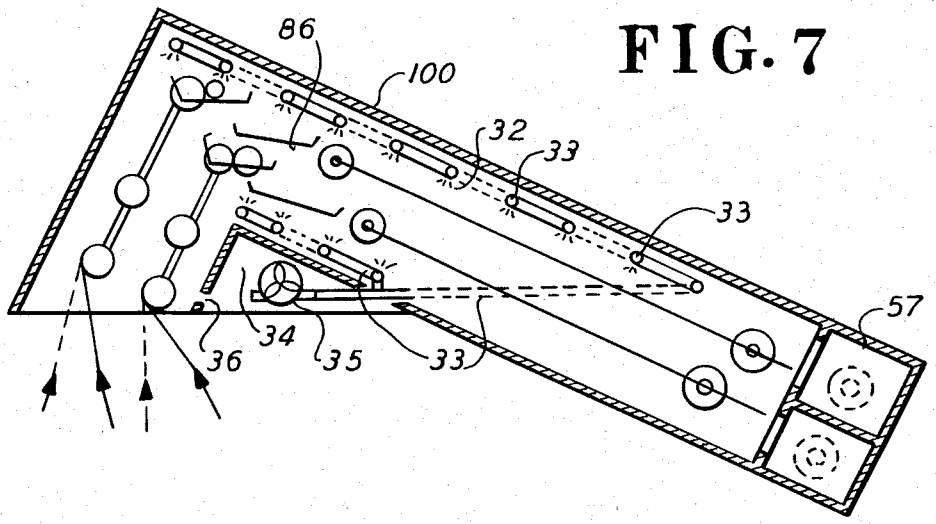
FIG. 7 is a schematic view showing a plurality of separate lines of fabric rolls being processed within a single chamber.

As shown in FIG. 7, chamber 100 may include two parallel conveyor lines or chains for processing two series of rolls. The entrance to the windup and rest stations is at a right angle to the inclined main chamber section containing the gravity driven chain. A pivoting arm 86 is used to transfer the roll from the rewind station to the inclined drive chain. A plurality of heater wires 32 are positioned adjacent the steam openings 33. A fan 35 is provided to adjust temperature and humidity and can draw excess steam from an exhaust area 34 through vent openings 36. Various heat and humidity sensors may be employed to control the heaters and fan to automatically maintain a desired temperature level. The exit to chamber 100 includes autoclave units 57 which may be used for applying additional high temperature high pressure steam treatment for special purposes.

Although a temperature of 100° C. is preferable for treatment of all fabrics and specifically required for use with synthetic fibers, natural fibers can be processed using lower temperatures of from 40°–60° C. In order to maintain the desired temperature, and prevent dryout, it is necessary to have moisture present on the surface of each roll. All types of diverse fabrics may be processed in any sequence, including knit and woven materials which can be dyed with any color or printed with striped patterns. While only a limited number of embodiments have been illustrated and described, it is apparent that many other variations may be made in the particular design and configurations without departing from the scope of the invention as set forth in the appended claims.

What is claimed is:

1. A system for treating fabric comprising:
- an enclosed chamber having an entrance and an exit and a plurality of stations therebetween;
- fabric supply means for feeding fabric continuously into said chamber;
- applicator means positioned in the path of said fabric for applying solutions to said fabric;
- take-up means at a first station within said chamber adjacent said entrance for winding said fabric into rolls;
- means within said chamber for applying heat and steam to the rolls of fabric;
- means for feeding successive rolls of fabric along said chamber and for holding respective rolls within selective stations for predetermined time intervals;
- a second rest station for permitting further application of heat and steam to said roll;
- a third rewind station including means for rewinding fabric from a first roll onto a second roll and means for subjecting said second roll to additional heat and steam capable of maintaining a predetermined temperature to provide uniform heat and moisture throughout the roll;
- a fourth station including gravity drive means for holding and moving a plurality of rolls successively toward said exit while continuing application of said heat and steam on said rolls; and
- means for holding said rolls upon exiting from said chamber.

2. The system of claim 1 wherein said rewinding means reverses the order of inner and outer fabric layers from said first roll to said second roll.

3. The system of claim 2 wherein said fabric supply means includes a plurality of fabric rolls positioned for successive feeding into said chamber, and said applicator means includes a plurality of applicators positioned adjacent said rolls for alternately applying solutions to successive fabric rolls.

4. The system of claim 3 wherein said gravity drive means includes an inclined continuous chain having stops spaced therealong for holding a plurality of rolls.

5. The system of claim 4 wherein said rewinding means includes a first lever arm supporting said first roll and a second lever arm supporting said second roll, said first and second arms being rotatable about a center, said second arm including a slidable weight movable therealong and a stop at the end, said first roll decreasing and said second roll increasing in size and weight as said fabric is unwound from said first roll onto said second roll to cause said first arm to rotate upwardly and said second arm to rotate downwardly to deposit said second roll onto said inclined continuous chain.

6. The system of claim 4 wherein said chamber includes partitions separating said stations and said means for applying heat and steam includes means for applying different amounts of heat to different stations.

7. The system of claim 4 wherein said chamber includes a plurality of separate parallel paths each having like means for winding said fabric into rolls, applying heat and steam, feeding successive rolls, rewinding and gravity drive means.

8. The system of claim 4 wherein said means for applying heat and steam includes a plurality of radiant heaters and a plurality of steam pipe inlets positioned along said chamber.

9. The system of claim 4 wherein said plurality of applicators are positioned on rails for movement into the path of said fabric.

10. The system of claim 4 including a plurality of enclosed chambers each including a plurality of successive stations for treating said rolls of fabric.

11. The system of claim 4 wherein the temperature applied during rewinding is substantially twice that during winding.

12. The system of claim 4 including a washing station following said means for holding said rolls upon exiting said chamber.

13. The system of claim 4 including means providing additional heating following said means for holding said rolls upon exiting said chamber.

14. The system of claim 3 wherein said second roll includes a perforated core and means for feeding steam into said core for penetrating the roll of fabric from within.

* * * * *